US005640826A

United States Patent [19]

Hurilla, Jr.

[11] Patent Number: 5,640,826

[45] Date of Patent: Jun. 24, 1997

[54] SHEETROCK LIFTING APPARATUS

[76] Inventor: Ray Hurilla, Jr., 636 Pitt St., South Plainfield, N.J. 07080

[21] Appl. No.: 548,147

[22] Filed: Oct. 25, 1995

[51] Int. Cl.[6] ..... B28D 7/04

[52] U.S. Cl. ..... 52/749.14; 52/127.1; 414/11

[58] Field of Search ..... 52/749.13, 749.14, 52/125.1, 127.1, 749.1, DIG. 1; 414/11

[56] References Cited

U.S. PATENT DOCUMENTS

| | | | |
|---|---|---|---|
| D. 324,474 | 3/1992 | Killins | D8/88 |
| 3,467,261 | 9/1969 | Jewell | 414/11 X |
| 3,642,150 | 2/1972 | Zizak | 214/15 W |
| 3,643,935 | 2/1972 | Bell | 414/11 X |
| 3,852,927 | 12/1974 | Birum, Jr. | 52/241 |
| 3,871,477 | 3/1975 | Kuest | 182/63 |
| 4,339,219 | 7/1982 | Lay | 44/11 |
| 4,709,527 | 12/1987 | Cooley | 52/749 |
| 5,129,774 | 7/1992 | Balseiro et al. | 414/11 |
| 5,249,405 | 10/1993 | Miller | 52/712 |

*Primary Examiner*—Carl D. Friedman
*Assistant Examiner*—Yvonne Horton-Richardson
*Attorney, Agent, or Firm*—David L. Volk

[57] ABSTRACT

A sheetrock lifting apparatus is provided having a rectangular support structure with a clamping end and a lifting end, a continuous clamping means located at the clamping end, and an adjustable support pole located at the lifting end. In its preferred embodiment, the continuous clamping means comprises a piano hinge running the continuous width of the clamping end and providing a series of regularly spaced attachment holes. In this configuration, the continuous hinge is fastened to the wall or ceiling beam at the desired number of locations by screws. The rectangular support structure is adjusted to it a length necessary to easily accommodate a section of sheetrock. The sheetrock is then placed against the support structure, and lifted to the ceiling by the user grasping the adjustable support pole. The pole's lower member is then telescoped down to the floor and locked into place, thereby locking into place the sheetrock in an overhead position, leaving the users hands free to continue working and completing the installation in a conventional manner.

3 Claims, 5 Drawing Sheets

SHEETROCK LIFTING APPARATUS

BACKGROUND OF THE INVENTION

1. Field of the Invention

The present invention relates generally to sheet rock installation tools and, more particularly, to an improved sheetrock lifting apparatus for aiding in the installation of sheetrock and other similar panel materials onto ceilings or other elevated areas.

2. Description of the Related Art

In the related art, many methods of temporarily supporting sheetrock and drywall during installation have been addressed. For example, in U.S. Pat. No. 5,249,405 issued in the name of Miller, a drywall support is disclosed providing for a temporary device for supporting drywall having a piercing end and a tongue, and is hammered into a joist or other support structure to form a temporary hanger clip which may be used to support sheetrock during installation. Such safety concerns with ceiling installations are self evident in that a sufficient supporting force is difficult to ascertain and impossible to guarantee.

Again in U.S. Pat. No. 4,709,527 issued in the name of Cooley, a sheetrock hanging tool is disclosed made from a rigid sheet, and can be used as a temporary "hanger" should a particular installation provide for an overhead joist having an accessible upper surface upon which to rest such a device.

Also, in U.S. Pat. No. Des. 324,474, an ornamental design for a gypsum board installation tool is disclosed providing a "notched" handle, apparently to make easier the task of carrying such long, heavy, thin objects such as sheetrock.

Other improvements in the related art of fastening sheetrock are also known, such as in U.S. Pat. No. 3,852,927 issued in the name of Birum Jr., disclosing an apparatus for mounting wallboard. However, such references tend generally to relay to methods for the permanent affixment of sheetrock during final installation.

In the prior art of sheetrock lifting apparatus, several references are known. The first is U.S. Pat. No. 3,871,477, issued in the name of Kuest, disclosing a sheetrock lift and scaffold. A device made in accordance with the disclosure in the Kuest reference incorporates generally a scaffold and a lift, both being adapted with elongated base and support members to aid in the support and balancing of wide, heavy, unstable loads such as when sheetrock is lifted for ceiling installations. A device made in accordance with the disclosure in Kuest., while effective, is an unwieldy, expensive, and very inflexible solution to the problems associated with sheetrock installation, and would appear to do so at a cost that would be out of reach for most individual homeowners or small contractor.

One attempt has been made to correct for the foregoing problems. In U.S. Pat. No. 3.642,150, issued in the name of Zizak, sheetrock scaffolding is disclosed in the form of a single elongated member having a brace at one extremity to which a pair of clamp means are pivotally mounted. Similar to the Zizak disclosure is U.S. Pat. No. 3,143,2199, issued in the name of Aldrich, in which a single elongated member has a single clamp means, and a brace is affixed at the opposite extremity.

While novelty and usefulness exist in all of the above mentioned related and prior art, there are many practical problems that occur during the installation of sheetrock to walls and ceiling boards. These problems become exaggerated if such installation is attempted by a lone individual. For example, sheetrock can be procured in a variety of standard sizes. Hence, adjustability of length is required. And, although studding is generally constructed at one of two standard separations, their orientation to any sheetrock installation is not standard, especially when utilizing wall studding to aid in the support of ceiling sheetrock installations. Finally, the use of a single elongated member to support a very large, very long piece of sheetrock can cause an individual a tremendous difficulty in terms of balancing and aligning the sheetrock.

Consequently, a need has therefore been felt for an improved but less complex mechanism that can adjust to varying lengths of sheetrock, can adapt to any wall stud configuration, and can be utilized by an individual in a safe, secure, and balanced manner in order to aid an individual in the installation of sheetrock.

SUMMARY OF THE INVENTION

It is therefore an object of the present invention to provide an improved sheetrock lifting apparatus.

It is another object of the present invention to provide an improved sheetrock lifting apparatus that can adjust to support varying lengths of sheetrock.

It is yet another object of the present invention to provide an improved sheetrock lifting apparatus that is adapted to be utilized with any wall stud configuration.

It is a feature of the present invention to provide an improved sheetrock lifting apparatus having a rectangular support structure which is securely rigid in both the vertical and horizontal planes in order to provide a secure platform for lifting sheetrock that is free of excessive swaying while in use.

Briefly described according to one embodiment of the present invention, a sheetrock lifting apparatus is provided having a rectangular support structure with a clamping end and a lifting end, a continuous clamping means located at the clamping end, and an adjustable support pole located at the lifting end. In its preferred embodiment, the continuous clamping means comprises a piano hinge running the continuous width of the clamping end and providing a series of regularly spaced attachment holes. In this configuration, the continuous hinge is fastened to the wall or ceiling beam at the desired number of locations by screws. The rectangular support structure is adjusted to it a length necessary to easily accommodate a section of sheetrock. The sheetrock is then placed against the support structure, and lifted to the ceiling by the user grasping the adjustable support pole. The pole's lower member is then telescoped down to the floor and locked into place, thereby locking into place the sheetrock in an overhead position, leaving the users hands free to continue working and completing the installation in a conventional manner.

An advantage of the present invention is that it can be easily adjusted to accommodate various lengths of sheetrock.

Another advantage of the present invention is that it is adapted for use with any wall stud configuration, and can even be utilized with a finished wall where the studding is not accessible.

Further, a preferred embodiment of the present invention has a rectangular support structure to minimize swaying, thereby making installation of sheetrock to ceilings easier and more accurate for the individual user.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

1. Detailed Description of the Figures

Figure 1:
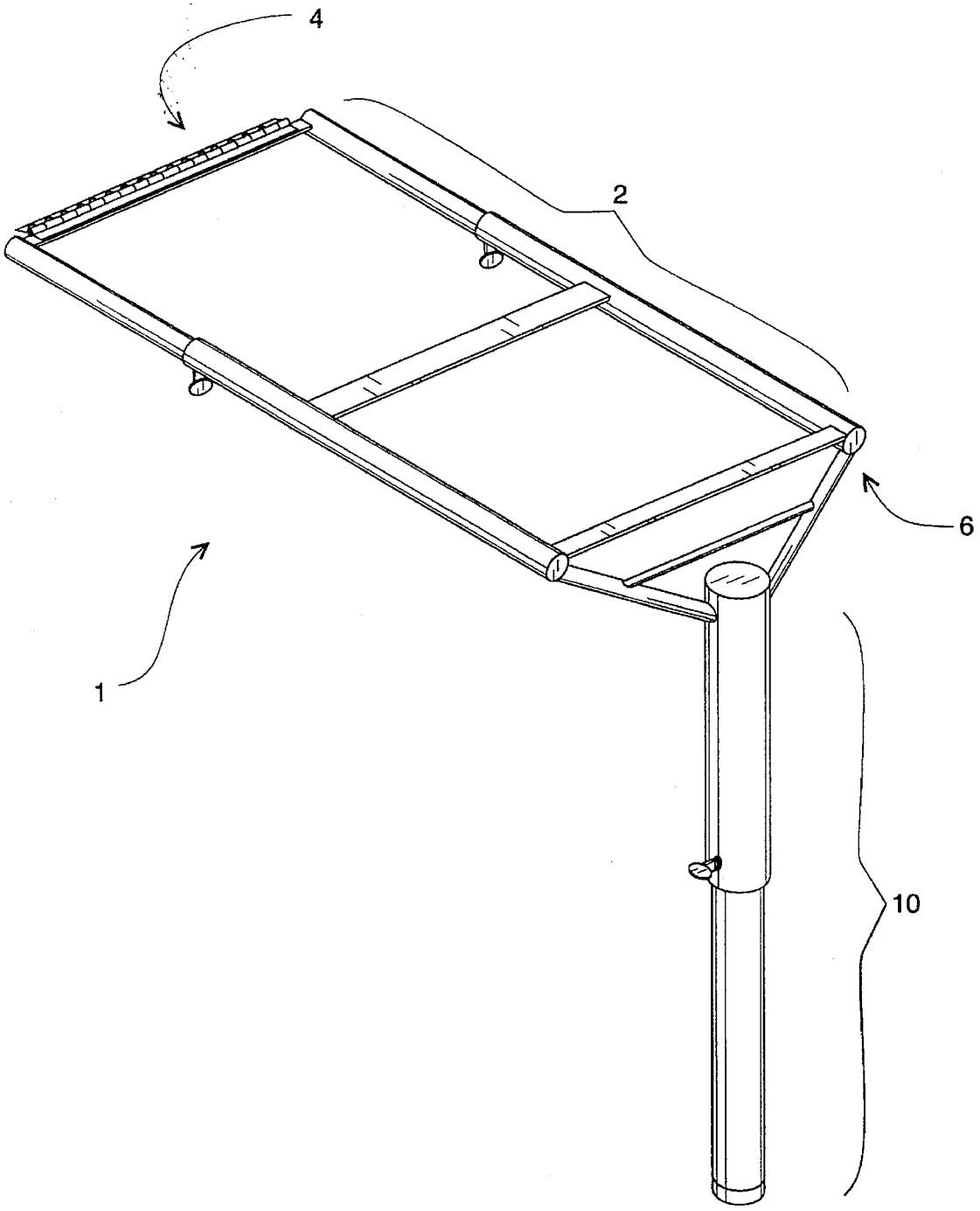
FIG. 1 is a perspective view of sheetrock lifting apparatus according to the preferred embodiment of the present invention.

Referring now to FIG. 1, a sheetrock lifting apparatus 1 is shown, according to the present invention, having a rectangular support structure 2 with a clamping end 4 and a lifting end 6, a continuous clamping means 8 located at the clamping end 4, and an adjustable support pole 10 located at the lifting end 6.

Figure 2:
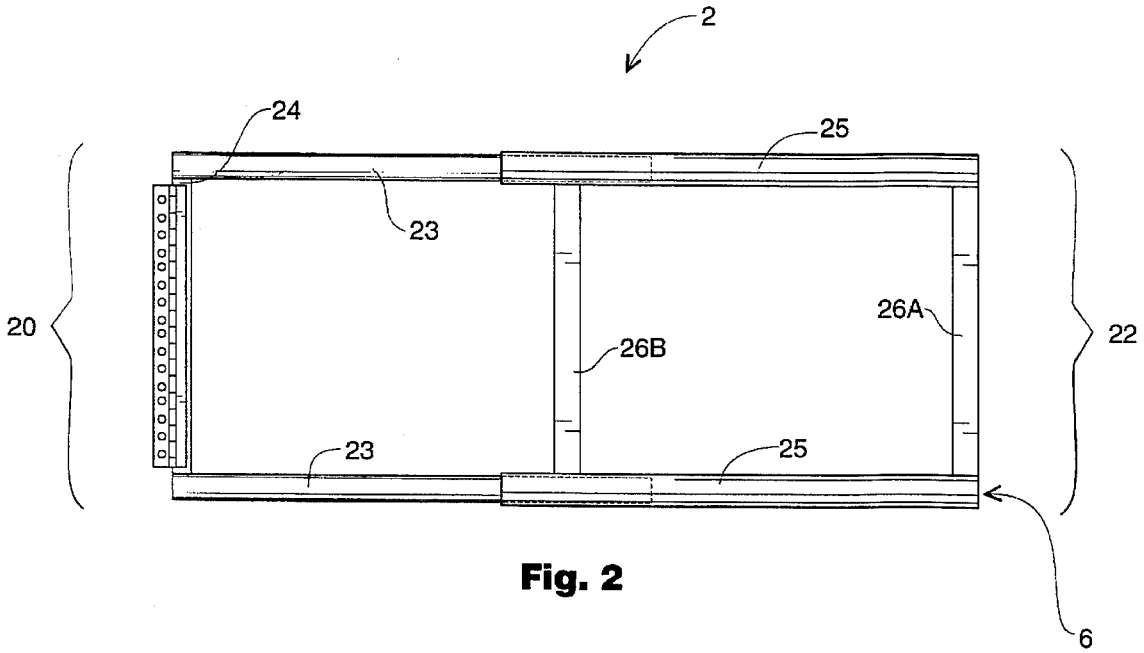
FIG. 2 is a view of a rectangular support structure for use therewith.
Figure 5:
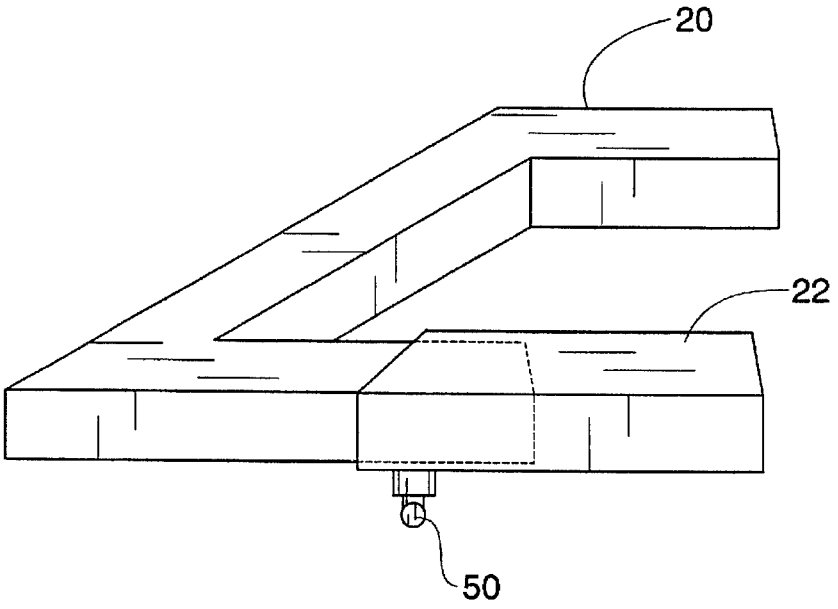
FIG. 5 is a perspective view of the length adjustment means of the preferred embodiment of the present invention.
Figure 6:
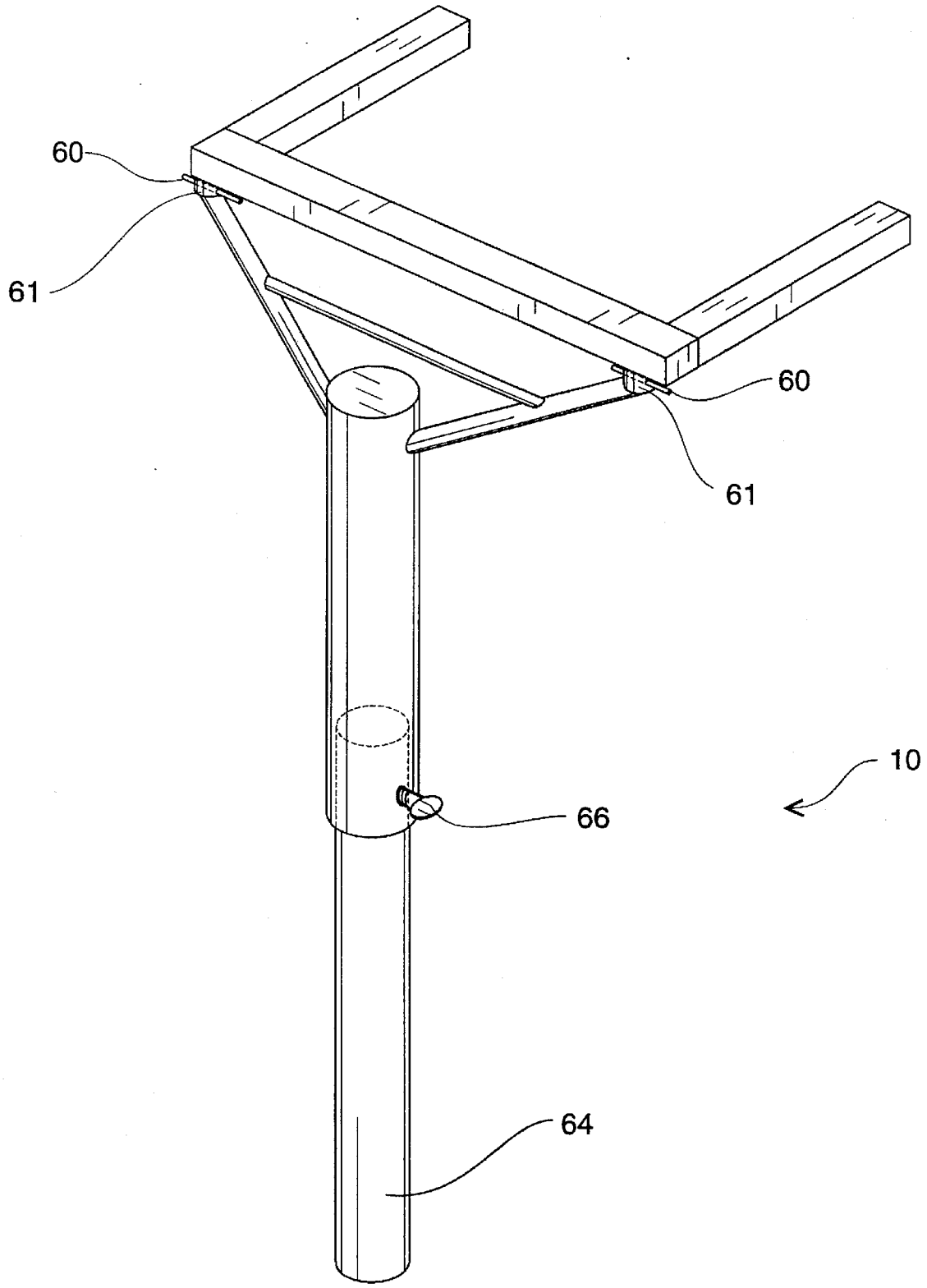
FIG. 6 is a perspective end view of an adjustable support pole for use therewith.

Referring to FIG. 2, the rectangular support structure 2 is shown. It consists of an inner member 20 and a telescoping outer member 22. The inner member consists of two parallel, elongated inner member rods 23, each adjoined at one end perpendicularly to a hinge brace 24, shown in better detail in FIG. 3 and FIG. 4. The telescoping outer member 22 forms a ladder-like structure having two hollow, parallel, elongated outer member rods 25 firmly connected by at least two crossbars 26A and 26B. The outer crossbars 26A is located at the lifting end 6, and provides a pivotal attachment means for the adjustable lifting pole as shown in FIG. 6 below. The inner crossbar 26B in conjunction with the outer members rods 25 and outer crossbar 26A form a rigid rectangular structure that is free of horizontal swaying, and eliminate the need for a user to have to precariously "balance" a large, heavy sheetrock member atop a single narrow support structure. Further, by telescoping the outer member 22 with the inner member 20 the overall length of the rectangular support structure 2 can be adjusted to the desired length, with the two members being secured by a locking means as shown in FIG. 5. Although various configurations and materials are currently envisioned, it is felt that the rectangular support structure 2 must be approximately 32 inches wide, and adjust between 8 feet to 14 feet in length in order to readily accommodate a majority of the standard materials and applications which could currently present themselves to the individual user. Also, in its preferred embodiment the rectangular support structure 2 can be easily manufactured from rectangular plastic tubing, thereby combining light weight, strength, and minimal manufacturing material costs.

Figure 3:
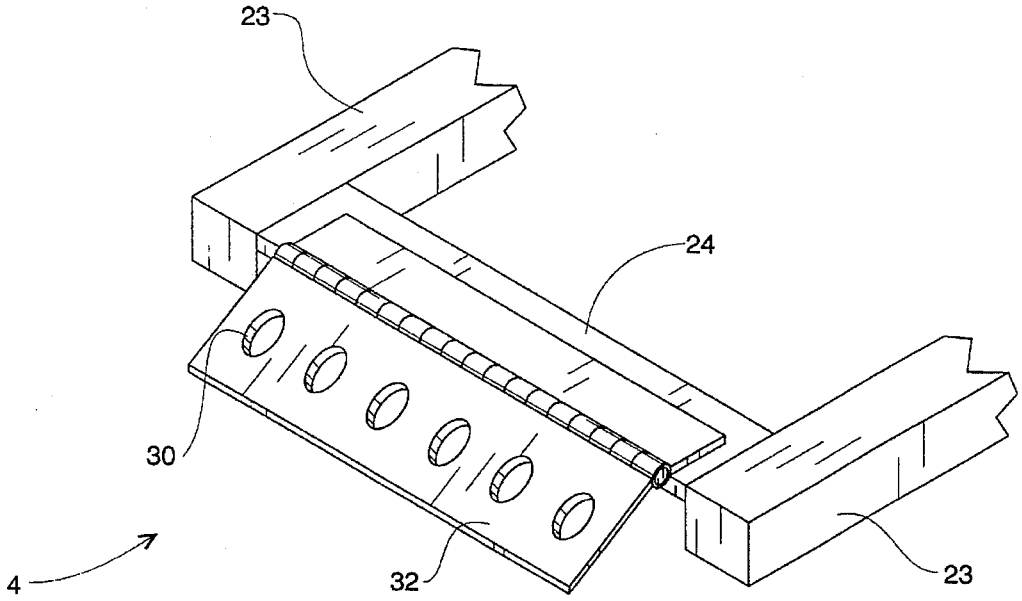
FIG. 3 is a perspective view of the clamping end thereof depicting a continuous hinge structure.
Figure 4:
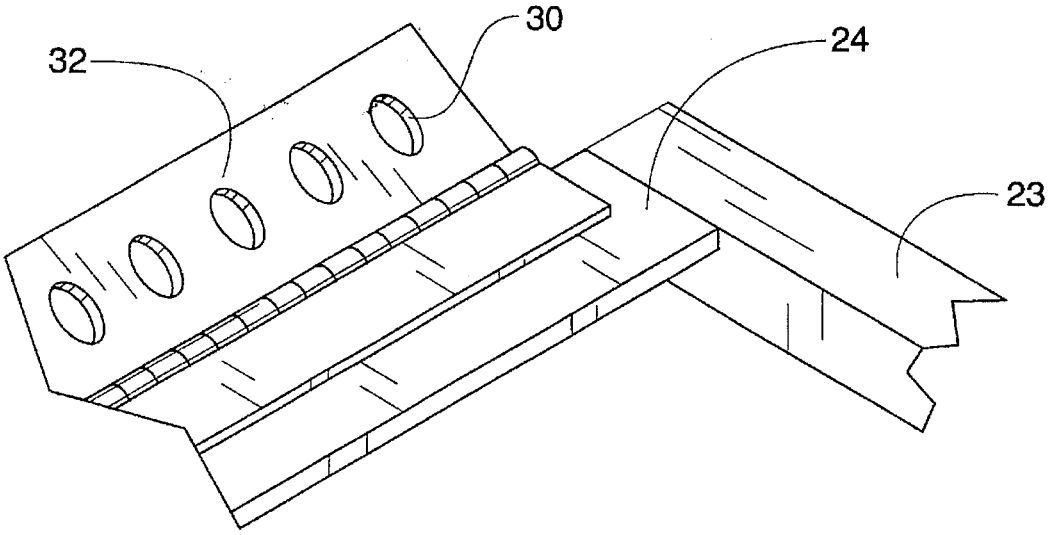
FIG. 4 is a partial reverse cutaway perspective thereof.

FIG. 3 and FIG. 4 shows in greater detail the clamping end 4. The hinge brace 24 securely mounts between and affixes together the inner member rods 23. The hinge brace 24 also provides the attachment point for the continuous clamping means 8. It is currently envisioned in the preferred embodiment that a continuous hinge such as a common "piano hinge" be utilized. Such a hinge runs the continuous width of the clamping end 4, and provides a series of regularly intervalled attachment holes 30. It is currently envisioned that, as in a conventional piano hinge, a large plurality of attachment holes fill the length of the hinges free side 32. In this configuration, the user would have a variety of attachment points to choose from, and could merely place the clamping end 4 into the desired position and attached it to a wall or ceiling by placing conventional screws through any number of attachment holes 30 that may align with studding or other support structures.

In FIG. 5, the inner member 20 is shown telescoping into the outer member 22. A locking means 50, shown in the preferred embodiment as a conventional thumb screw, can then be easily clamped down by the user to lock together the inner member 20 and the outer member 22 to form a single, rigid rectangular support structure 2.

Finally, in FIG. 6 an adjustable lifting pole 10 is shown having a conventional structure. Pivot points 60 located at the lifting end 6 engage with lifting pole pins 61 available at the top of the lifting pole 10. As is necessary and utilized in the present art, the lifting pole 10 is best adapted as a telescoping member having a base section 64 for grounding to the floor and a telescoping upper section 65, with a conventional locking means 66 for the user to easily lock in place the two sections. It is currently envisioned that the thumbscrew type arrangement as shown in FIG. 5 would provide for adequate functionality.

2. Operation of the Preferred Embodiment

Figure 7:
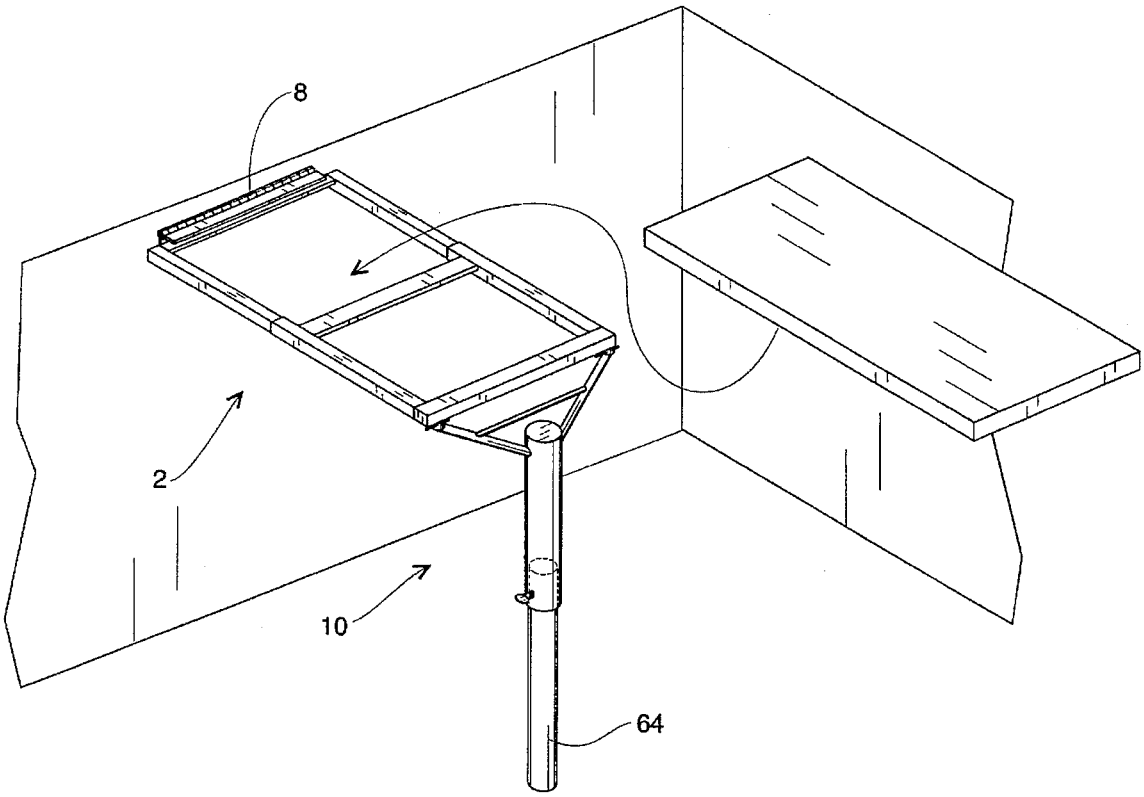
FIG. 7 is a perspective view of the preferred embodiment of the present invention while in use.

In accordance with a preferred embodiment of the present invention, as shown in FIG. 7, the continuous clamping means 8 shown as a continuous piano hinge is fastened to the wall or ceiling beam at the desired number of locations by screws. The rectangular support structure 2 is adjusted to it a length necessary to easily accommodate a section of sheetrock. The sheetrock is then placed against the support structure 2, and lifted to the ceiling by the user grasping the adjustable support pole 10. The base section 64 is then telescoped down to the floor and locked into place, thereby locking into place the sheetrock in an overhead position, leaving the users hands free to continue working and completing the installation in a conventional manner.

The foregoing description is included to illustrate the operation of the preferred embodiment and is not meant to limit the scope of the invention. The scope of the invention is to be limited only by the following claims.

What is claimed is:

1. An improved sheetrock lifting apparatus comprising:

a rectangular sheetrock support structure, said support structure having a fixed width and an adjustable length, and said support structure further having a lifting end and a clamping end, said sheetrock support structure further comprising an inner member, said inner member having a pair of elongated inner member rods mounted in parallel and perpendicular to a hinge brace forming said clamping end, an outer member having a pair of outer member rods, mounted in parallel and connected perpendicularly to an outer crossbar and an inner crossbar to form a rigid, rectangular structure, and locking means for manually locking together said outer member to said inner member to form a rigid, rectangular structure;

a continuous piano hinge affixed to said clamping end for pivotally and removably affixing said support structure to a wall, ceiling, or similar flat structure; and an adjustable support pole, said support pole for mounting to and holding said lifting end of said support structure, wherein said support pole comprises an upper end, pivotal attachment means for removably attaching said upper end in a pivotal fashion to said lifting end, an elongated, telescoping base fitting into said upper end for extending the length of said support pole, and second locking means for manually locking together said upper end to said base to form a rigid, vertical support pole.

2. The sheetrock supporting apparatus as described in claim 1, wherein said second locking means comprises at least one conventional hand manipulated screw penetrating said upper end and impinging against said base.

3. In a sheetrock lifting apparatus as described in claims 2, the improvement further comprising said outer member fitting said inner member is adjustably telescoping such that the rectangular sheetrock support structure can be adjusted between an overall length from between approximately 8 feet to approximately 14 feet.

* * * * *